US008651448B2

(12) United States Patent
Rosati

(10) Patent No.: US 8,651,448 B2
(45) Date of Patent: Feb. 18, 2014

(54) MEANS OF STRIPPING CONCRETE FORMWORK FROM A CONCRETE SURFACE

(76) Inventor: Wasyl Rosati, New South Wales (AU)

( * ) Notice: Subject to any disclaimer, the term of this patent is extended or adjusted under 35 U.S.C. 154(b) by 375 days.

(21) Appl. No.: 12/674,454

(22) PCT Filed: Aug. 21, 2008

(86) PCT No.: PCT/AU2008/001225

§ 371 (c)(1),
(2), (4) Date: Jun. 29, 2010

(87) PCT Pub. No.: WO2009/023926

PCT Pub. Date: Feb. 26, 2009

(65) Prior Publication Data

US 2010/0288909 A1 Nov. 18, 2010

(30) Foreign Application Priority Data

Aug. 22, 2007 (AU) ..... 2007904522

(51) Int. Cl.
*E04G 11/56* (2006.01)

(52) U.S. Cl.
CPC ..... *E04G 11/56* (2013.01)
USPC ..... 249/18

(58) Field of Classification Search
USPC ..... 249/18, 26, 27, 28
See application file for complete search history.

(56) References Cited

U.S. PATENT DOCUMENTS

| | | | | | |
|---|---|---|---|---|---|
| 857,524 | A | * | 6/1907 | Hindman et al. | 249/29 |
| 1,498,665 | A | * | 6/1924 | MacIvor | 249/18 |
| 2,671,697 | A | * | 3/1954 | North | 425/62 |
| 3,037,259 | A | * | 6/1962 | Dave | 425/62 |
| 3,190,405 | A | * | 6/1965 | Squire | 52/637 |
| 3,313,081 | A | * | 4/1967 | Squire | 52/645 |
| 3,329,105 | A | * | 7/1967 | McPherson | 108/4 |
| 3,420,030 | A | * | 1/1969 | Kosmach et al. | 52/637 |
| 3,520,508 | A | * | 7/1970 | Tooley et al. | 249/18 |
| 3,604,175 | A | * | 9/1971 | Gray | 52/637 |
| 3,822,853 | A | * | 7/1974 | Shelley | 249/27 |
| 3,826,057 | A | * | 7/1974 | Franklin | 52/641 |
| 3,902,289 | A | * | 9/1975 | Dashew | 52/126.7 |
| 3,940,105 | A | | 2/1976 | Metrailer | |
| 3,977,536 | A | * | 8/1976 | Moore et al. | 249/18 |
| 4,003,541 | A | * | 1/1977 | Lanier | 249/18 |
| 4,026,079 | A | * | 5/1977 | Morris | 52/126.7 |

(Continued)

FOREIGN PATENT DOCUMENTS

| | | |
|---|---|---|
| CA | 1166867 | 5/1984 |
| EP | 105504 | 8/1984 |
| GB | 1052097 | 12/1966 |
| GB | 1102423 | 2/1968 |

*Primary Examiner* — Michael Safavi
(74) *Attorney, Agent, or Firm* — Greenblum & Bernstein P.L.C.

(57) ABSTRACT

The invention is a frame for use with formwork to support the formwork for concrete casting and for stripping formwork from a concrete surface where a frame is moveable between a first and second position that supports and holds formwork in place for concrete casting in a first position and that retracts to a second position so as to lower the formwork away from the concrete surface wherein sufficient force is applied to the formwork as the frame retracts to the second position to strip it from the concrete surface. The invention provides a means of both supporting formwork during concrete casting as well as a means of stripping and lowering the formwork after the concrete is cast.

14 Claims, 8 Drawing Sheets

(56) References Cited

U.S. PATENT DOCUMENTS

| | | | | | |
|---|---|---|---|---|---|
| 4,036,466 | A | * | 7/1977 | Van Meter | 249/18 |
| 4,078,759 | A | * | 3/1978 | Lanier | 249/18 |
| 4,492,358 | A | * | 1/1985 | Manderla | 249/18 |
| 4,569,501 | A | * | 2/1986 | McCracken | 249/209 |
| 4,693,449 | A | * | 9/1987 | Cunningham | 249/210 |
| 4,787,183 | A | * | 11/1988 | Johnston | 52/126.4 |
| 5,338,498 | A | * | 8/1994 | Lefebvre | 264/31 |
| 5,616,349 | A | * | 4/1997 | Sasaki | 425/62 |

* cited by examiner

MEANS OF STRIPPING CONCRETE FORMWORK FROM A CONCRETE SURFACE

This invention relates to a means of stripping concrete formwork from the concrete surface and in particular to providing a means of assisting a separation of the formwork from the formed concrete surface.

BACKGROUND OF THE INVENTION

In known building practice, formwork is assembled on a surface or on a lower floor level to form the next level of the building above. The formwork includes box forms to create columns, table forms to form concrete beams extending between the columns and lost formwork to fill the regions between the beams.

Lost formwork and the table forms are normally held in position by scaffolding. The scaffolding is assembled on to the surface or floor below with the lost formwork and table forms being supported on the scaffolding. The table forms are lowered in to position on to the scaffolding by cranes.

The lost formwork comprises rolled sheet metal sections which are left place after the concrete sets.

The table forms normally have plywood surfaces against which the concrete is poured. A series of joists are spaced along the underneath surface of the plywood and further bearers are located under the joists which locate on the scaffolding to support the formwork.

The scaffolding is strong enough to support concrete which is then poured on to the formwork to create the next floor above. Once this concrete is set, and becomes self supporting, then the scaffolding and formwork can be removed from beneath.

Normally, scissor lift mechanisms or platforms are used to support the table forms while the scaffolding is removed. The table form formwork is then prised away from the concrete surface and lowered to ground level. All the components are stacked for the removal from the building site by forklift and crane.

In the past, it has been proposed to use carriage systems to replace scaffolding to allow raising and lowering of the concrete formwork. An example of this is shown in British Patent No. GB1052097. According to this specification, the formwork can be raised to the required position and supported there while the concrete is poured on above. Once the concrete is set, then the concrete formwork is lowered to then be removed.

However, a significant problem with this process is the adherence of the formwork to the concrete surface. Force is required to part the formwork from the concrete surface, and this is normally achieved by levering the formwork away from the surface. The arrangement shown in the British Specification referred to above will not pull the formwork down. The adherence to the formwork to the concrete is such that the formwork will remain on the concrete as the frame is lowered.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY OF THE INVENTION

Accordingly, in one aspect, the invention is a framework for use with formwork to support the formwork for concrete casing and for stripping the formwork from a concrete surface comprising;

- a frame moveable between a first and second position that supports and holds the formwork in place for concrete casting in a first position and that retracts to a second position so as to lower the formwork away from the concrete surface, and wherein sufficient force is applied to the formwork as the frame retracts to the second position, to strip the formwork from the concrete surface.

In a further aspect the invention may be said to reside in a framework for use with formwork to support the formwork for concrete casting and for stripping the formwork from a concrete surface, the framework comprising;

- a frame moveable between a first and a second position relative to the framework, where the frame supports and holds the formwork in place for concrete casting in the first position and retracts to the second position; and
- a brace extending from a framework portion other than the frame to the concrete surface; wherein in use, the brace ensures that the movement of the frame from its first to its second position results in the stripping of the formwork from the concrete surface.

In one form, the framework comprises a lower frame that is floor or ground engaging, and the movable frame is an upper frame that is moveable up or down with respect to the lower frame.

In one form, the brace extends from the lower frame to the concrete surface, and wherein in use, the brace ensures that movement of the upper frame from its first to its second position results in stripping by preventing upward movement of the lower frame.

The invention will have numerous applications in the forming of concrete. The invention is equally suited to the formation of vertical surfaces as well as horizontal surfaces but the invention is particularly suited to the formation of horizontal concrete members such as floors in a multi-story building. The frame may comprise a lower frame portion that is floor or ground engaging and an upper support portion that is moveable up or down in relation to the lower frame portion. The upper support portion is designed to support and hold the concrete formwork in its first uppermost position and to allow lowering of the formwork to the second position by moving the upper support portion with respect to the lower frame portion.

The movement of the upper support portion with respect to the lower frame portion may be by way of one or more hydraulic cylinders. As mentioned above, the adhesive force between the concrete formwork and the concrete surface after curing of the concrete may be sufficient for the hydraulic cylinder to lift a light lower frame portion relative to the upper support portion. To overcome this problem in one aspect of the invention, at least one brace, that comprises a column, may extend through the concrete formwork so that it is in contact with the concrete surface at its upper end. The lower end is securable with respect to the lower frame portion. This effectively creates a column that extends from the lower floor or ground surface to the concrete surface above.

Accordingly, when the upper support portion is pulled downwardly, the brace and lower frame portion resists any upward movement of the lower frame portion thereby creating a downward pull on the upper support portion and the concrete formwork. Sufficient force can then be applied to the concrete formwork to strip it away from the concrete surface.

Two or more braces may be provided and one brace or a set of two or more braces may be provided at the ends or on each side of a rectangular frame.

BRIEF DESCRIPTION OF THE DRAWINGS

In order to fully understand the invention, a preferred embodiment will now be described. However, it will be realised that the embodiment is not to be restricted to the precise details of the embodiment and that variations and alterations such as would be apparent to persons skilled in this area are to be deemed within the scope of the invention.

This embodiment is illustrated in the accompanying drawings in which.

In the following description, like reference characters designate like or corresponding parts throughout the several views of the drawings.

DESCRIPTION OF A PREFERRED EMBODIMENT

Figure 1:
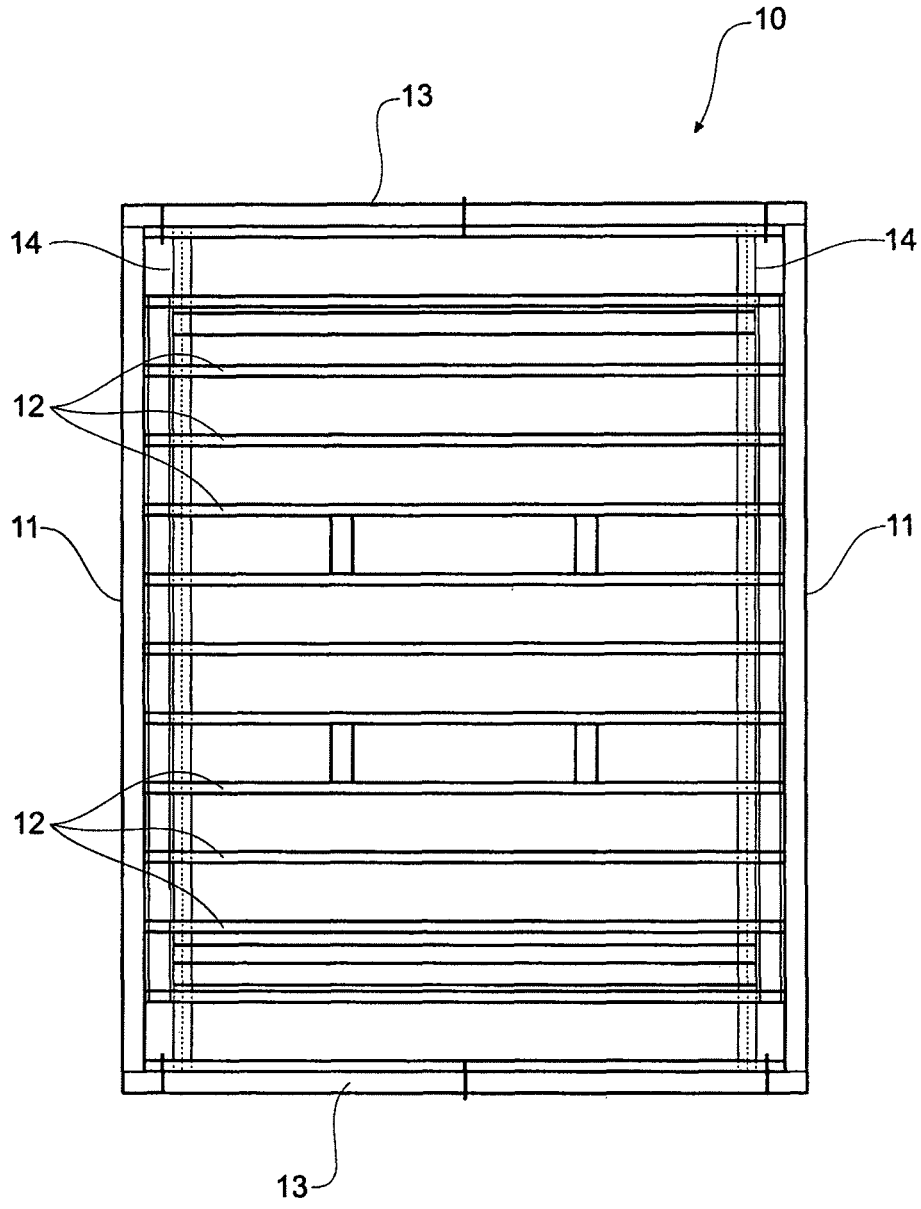
FIG. 1 shows a plan view of a table formwork support frame.

Referring to FIG. 1, where there is illustrated a table form framework 10 on which plywood is placed to form a surface for casting concrete. The framework 10 is rectangular and has perimeter beams 11 between which a plurality of joists 12 extend. End beams 13 are parallel to the joists 12 and are secured to the perimeter beams 11. A pair of joist bearers 14 that are parallel and spaced inwardly from the perimeter beams 11 are located underneath the joists 12 and are used to support the framework 10.

A lower frame 16 comprises four corner legs 17 which are square tubing. End and side rails 18, 19 extend between each of the corner legs 17 and are welded to the upper ends of the corner legs 17. Batons 20 are welded at each end to the corner leg 17 and a respective end or side rail 18, 19 to provide bracing support for the corner legs 17 with respect to the end and side rails 18, 19.

Below the end rails 18 at each end of the lower frame portions 16, there is a pair of lower rails 21 welded on either side at their ends to the corner legs 17.

An upper frame 23 comprises four tubular supports 24 which are telescopically located within each of the corner legs 17. The supports 24 at each end of the lower frame 16 have a beam 25 extending between and secured to the upper ends of the supports 24. A bracket 26 is provided at the top of each support 24 to which the beam 25 is secured to by a removable metal pin 27. The bracket 26 supports both the beam 25 and the joist bearers 14. The joist bearers 14 are also releasably secured with respect to the bracket 26.

In this manner, the formwork is supported by the upper frame 23 and the upper frame 23 is in turn supported by the lower frame 16. An hydraulic actuator 30 is provided at each end of the lower frame 16. The hydraulic actuator 30 comprises a hydraulic cylinder (not drawn) which is located within two telescoping tubular portions. These tubular portions comprise a lower tube 31 and an upper tube 32 that telescopically slides within the lower tube 31.

One end of the hydraulic cylinder is secured with respect to the lower end of the lower tube 31 and the upper end of the ram that extends out of the hydraulic cylinder is secured internally to the upper end of the upper tube 32. The lower tube 31 is secured between the rails 21 and the upper end of the upper tube 32 is secured via a bracket 33 to the beam 25. The hydraulic actuators 30 are shown in their fully extended positions in FIGS. 2*b* and 3*b* and in their fully contracted positions in FIGS. 2*a* and 3*a*. The hydraulic actuators 30 are used to extend the upper frame 23 upwardly with respect to the lower frame 16. They are also used to provide a downward force to the upper frame 23 when the framework 10 is to be pulled away from the concrete surface.

Figure 7:
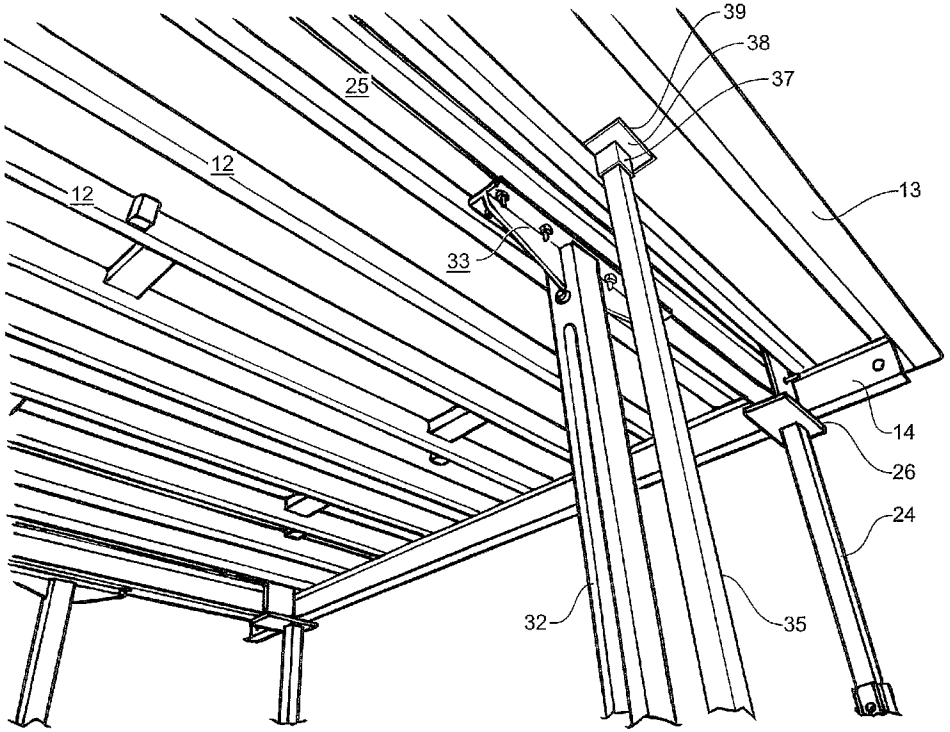
FIG. 7 shows a part underside view of the formwork support, the upper tube of the hydraulic actuator and the brace.

Referring to FIGS. 2*a*, 2*b*, 3*a* and 3*b*, a brace 35 is provided at each end of the upper frame 23. The brace 35 locates through a collar 36 that is attached to each of the end rails 18. The brace 35 is releasably securable with respect to the collar 36 by either pinning or clamping. The upper end of the brace 35 locates through a collar 37 which is secured with respect to one of the joists 12. The upper end of the brace 35 above the collar 37 has a flat plate 38 welded to it which is designed to come into contact with the concrete surface. The metal plate is square and protrudes through a corresponding aperture 39 (See FIG. 7) in the plywood which is placed on the framework 10 to form a flush surface with respect to the plywood. A sealing compound can be used between the plywood and the metal plate 38 if required.

Figure 2A:
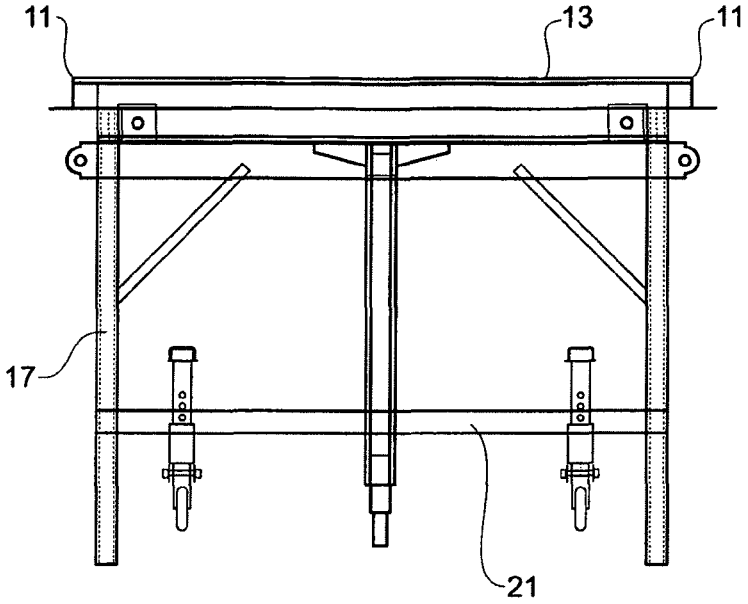
FIGS. 2*a*, 2*b*, 3*a* and 3*b* show side elevation views of lower frame and upper support portions used to support the table formwork support frame in extended and retracted positions.
Figure 2B:
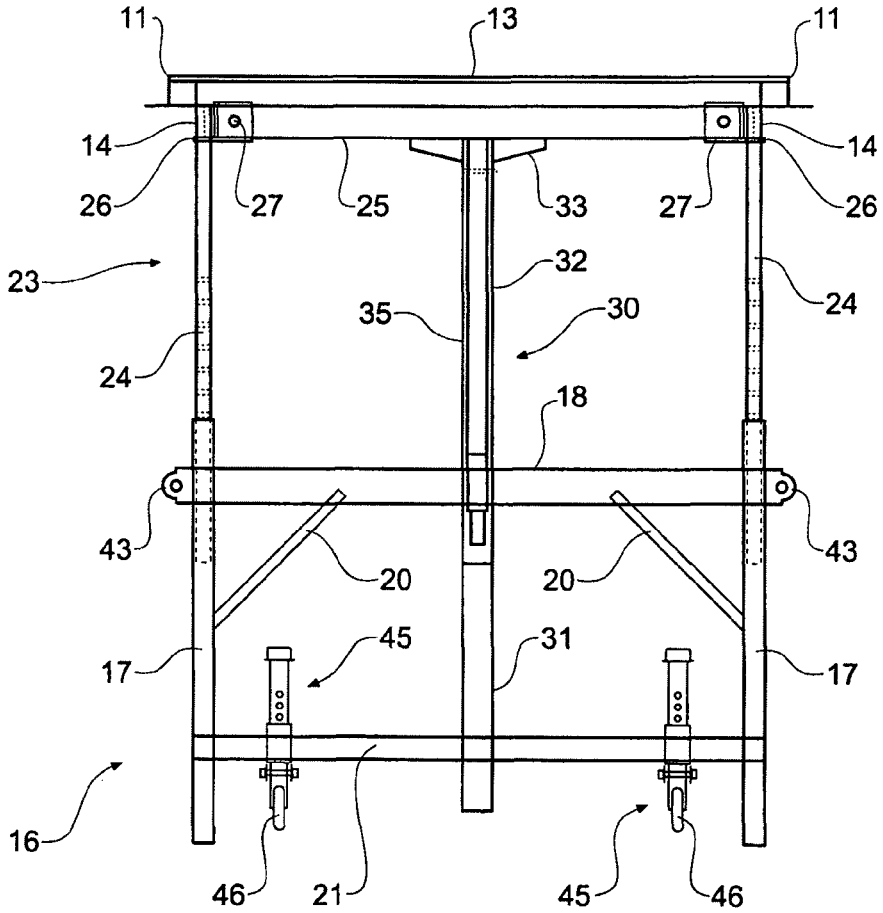
Figure 3A:
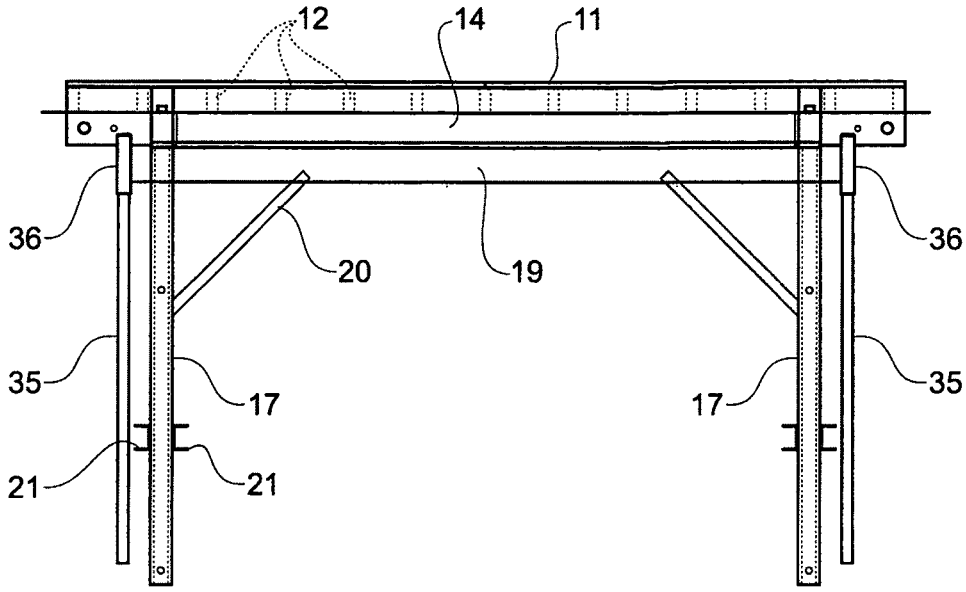
Figure 3B:
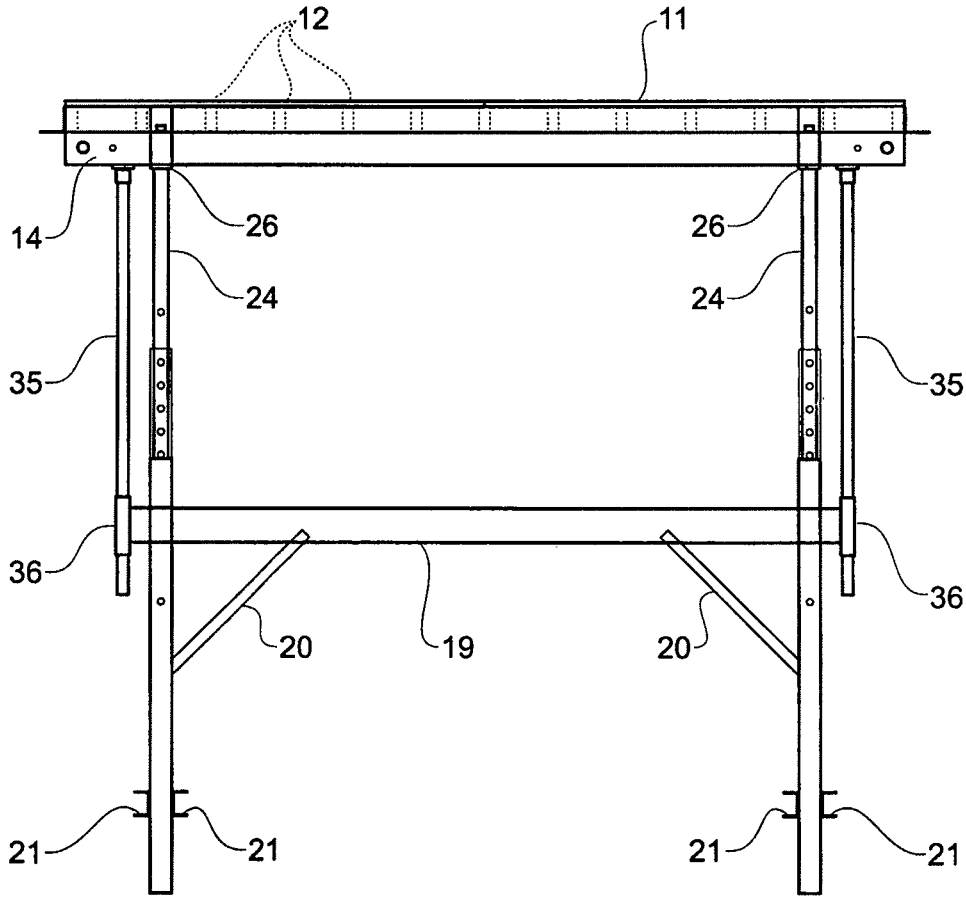
Figure 4A:
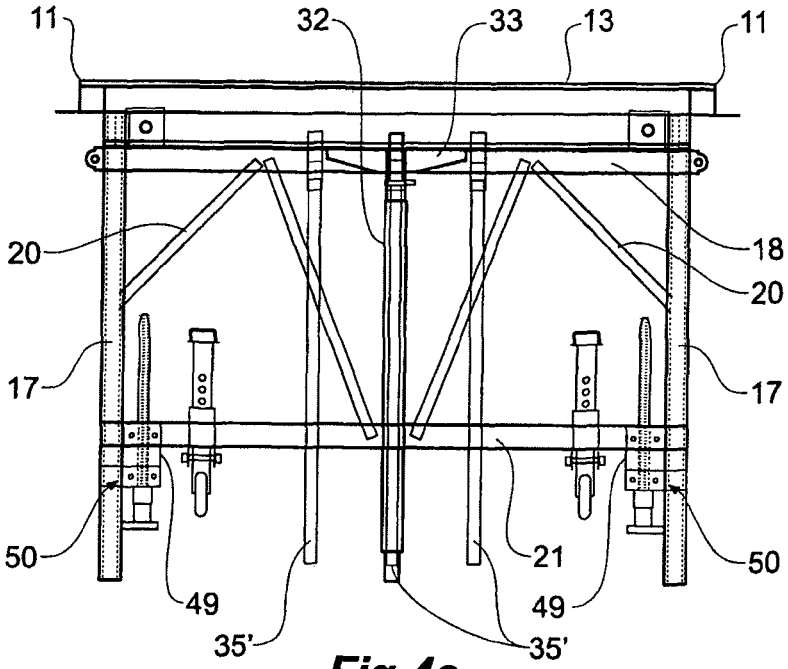
FIGS. 4*a*, 4*b*, 5*a* and 5*b* show side elevation views of lower frame and upper support portions used to support the table formwork support frame in extended and retracted positions having a multiple number of braces.
Figure 4B:
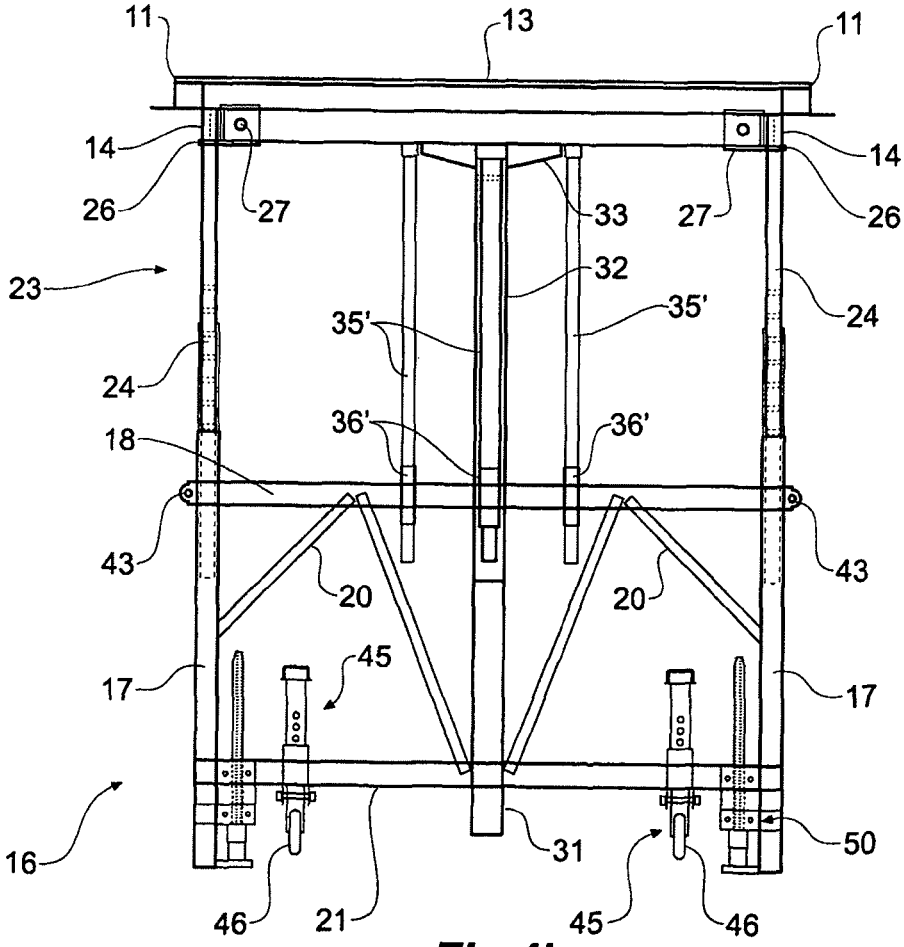
Figure 5A:
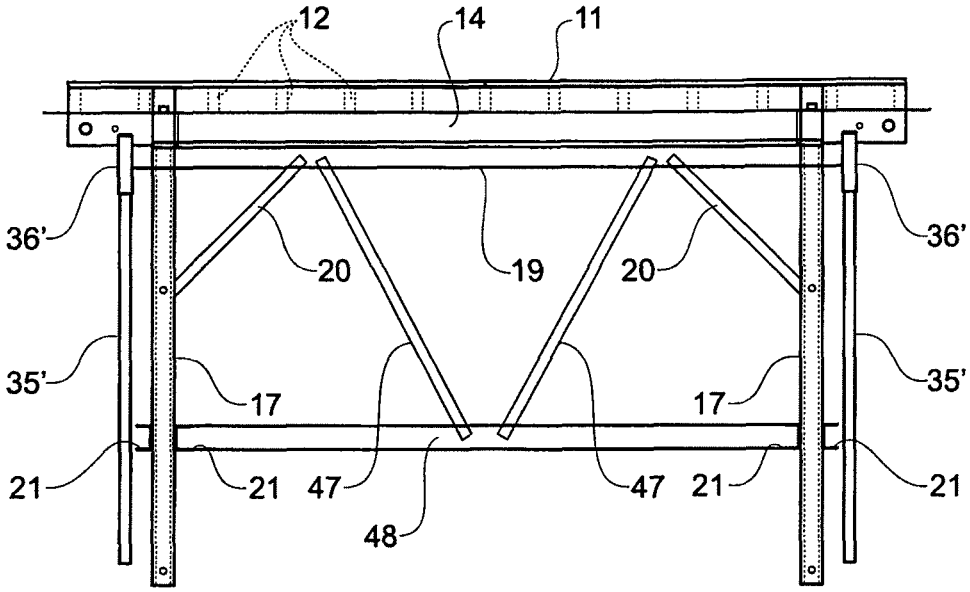
Figure 5B:
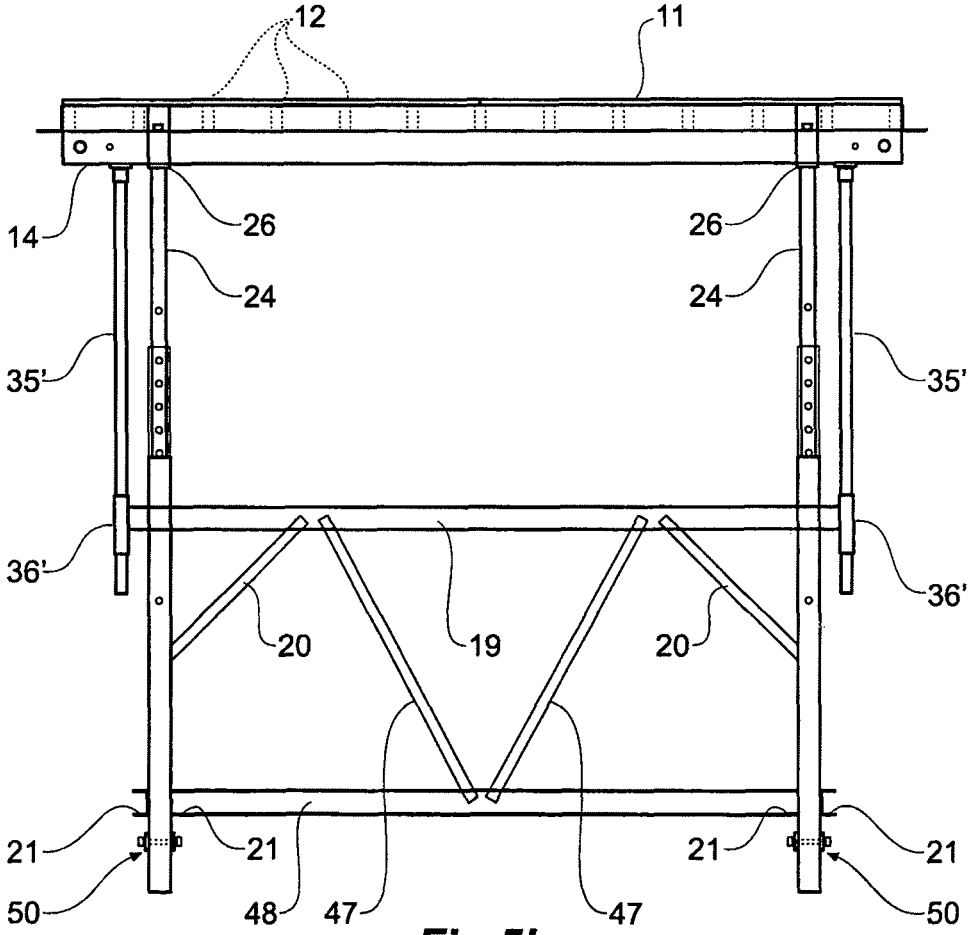

With the brace 35 locked with respect to collar 36, when the upper support portion 23 is lowered via the hydraulic actuators 30, the brace 35 and the lower frame 16 are held between the surface on which the lower frame portion 16 sits and the concrete surface formed above the table form framework 10. When the concrete sets, and the hydraulic actuator 30 is operated so as to retract the upper frame 23 from its first position shown in FIGS. 2*b* and 3*b* to its second position shown in FIGS. 2*a* and 3*a*, any lifting force of the lower frame 16 is resisted by the braces 35. In effect, the brace 35 applies a force to the lower frame 16 that is substantially in the same direction as the movement of the upper frame 23 as it moves from its first to second position which in turn causes the formwork supported by the table form framework 10 to be pulled away from the concrete surface that has been formed. In this manner, the adhesion between the plywood formwork and the concrete surface is overcome which results in the formwork being stripped away from the concrete surface. Once the formwork is released from the concrete surface, then the braces 35 can be released with respect to the collars 36 so that they can slide through the collars 36 to a retracted lower position as shown in FIGS. 2*a* and 3*a*.

An alternative arrangement is show in FIGS. 4*a*, 4*b*, 5*a* and 5*b* where three braces 35' are provided at each end of the upper frame 23. Three separate collars 36' are provided respectively for each brace 35'. The use of three braces 35' at each end of the framework 10 decreases the load applied to each brace 35' and spreads the pulling load across the each end of the upper frame 23.

Figure 6:
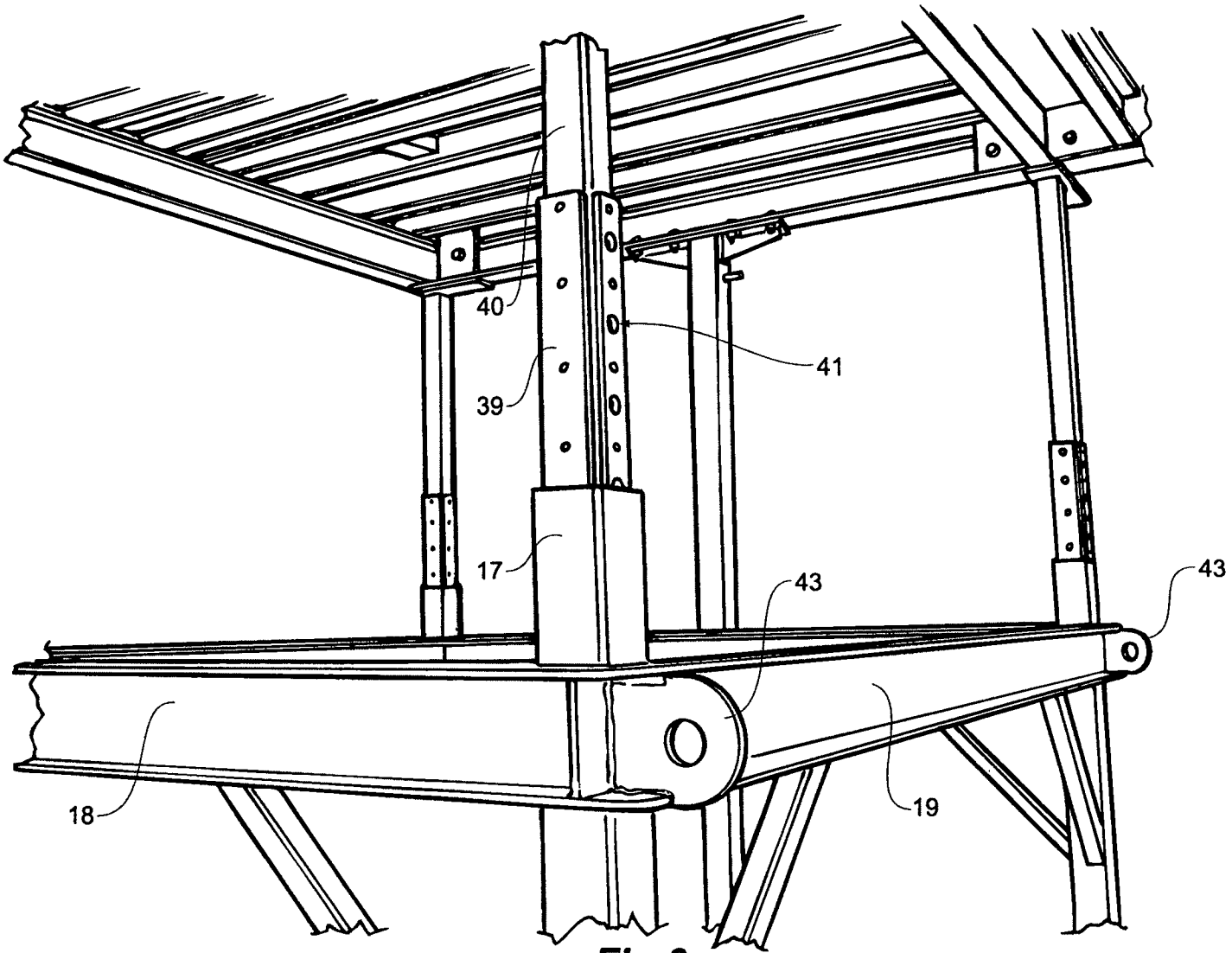
FIG. 6 shows detail of a corner leg on the lower frame portion and a tubular support of the upper frame engaging a leg on the lower frame.

Referring to FIG. 6, the supports 24 may comprise a lowered tube portion 39 and an upper tube portion 40 that telescopically slides within the lower tube portion 39. The lower tube portion 39 and upper tube portion 40 are provided with apertures through which pins may locate to hold the upper tube portion 40 with respect to lower tube portion 39. This enables the height of the upper support portion 23 to be increased or decreased to suit varying heights between floors of different types of buildings. Further, the lower tube portion 39 has a number of apertures 41 along its length through which a pin may locate to secure the supports 24 with respect to each corner leg 17. This enables the load of the upper frame 23 to be supported by these pin joints rather than on the hydraulic actuators 30 alone.

Brackets 43 are located at each end of each of the end rails 18. These brackets 43 have an aperture therein which enable adjacent lower frame 16 portions to be secured with respect to one another.

Figure 8:
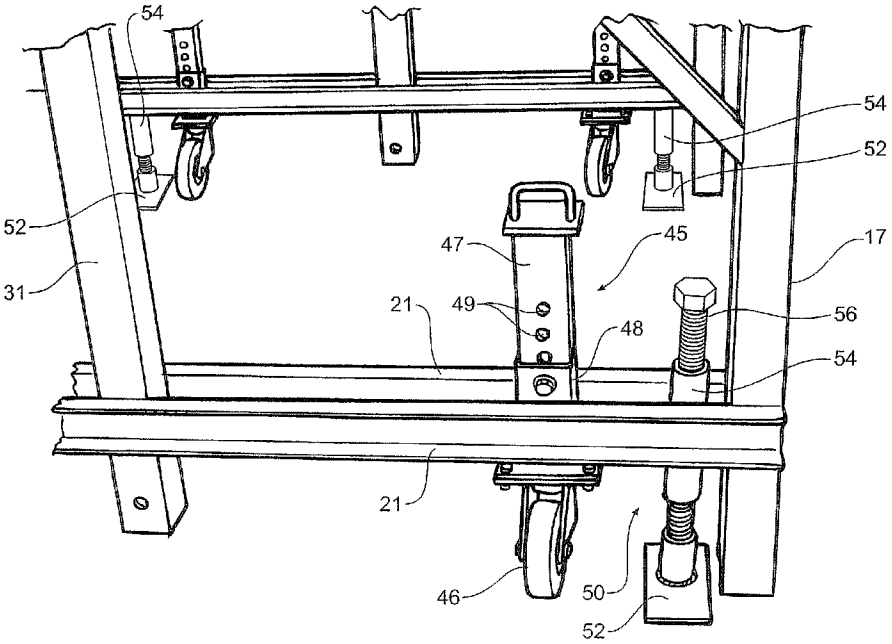
FIG. 8 shows a castor wheel and jacking support.

Referring to FIG. 8, a pair of castor wheel assemblies 45 is positioned between the rails 21 at each end of the lower frame 16. Each of the castor wheels 46 are attached to the lower end of a post 47 which in turn locates through a collar 48. The collar 48 is welded to both of the rails 21 and the post 47 has a series of apertures 49 which align with a corresponding aperture in collar 48 which enables pinning of the post 47 at different heights.

When the hydraulic actuator 30 pulls the upper frame 23 downwardly, the supports 24, in their lower most position project from the lower ends of the legs 17. This lifts the legs 17 clear of the support surface. In this position, the post 47 can be dropped so that the castor wheel 46 engages the support surface and the post 47 can be pinned in place. The hydraulic actuator 30 is then operated to raise the upper frame 23 slightly so that the ends of the supports 24 are no longer in engagement with the ground surface. With the ends of the legs 17 clear of the ground surface, the lower frame portion 16 can be moved around readily on the castor wheels 46.

FIG. 8 also shows jacking supports 50 which are also secured between the rails 21. The jacking supports 50 enable fine adjustment of the level of the framework 10 at each corner of the lower frame portion 16. A threaded foot can be screwed out of a support so as to extend or retract the jacking support 50. This enables fine adjustments to be made to bring the framework 10 to an exact level position prior to pouring of the concrete. This means that the load of the formwork and frame 10 is supported by the jacking supports 50. FIGS. 4*a*, 4*b*, 5*a* and 5*b* show an alternative jacking support 50. In those figures, a longer lead screw is used that is adjusted by engaging a spanner on the top of the lead screw. Also, a bracket attached to both the rails 21 and the leg 17 is used to support the lead screw.

As can be seen from the above description, the combination of the lower frame 16 and upper frame 23 make it very simple to bring into position the table form framework 10 prior to concrete being poured. The castor wheels 46 enable easy movement and positioning of the table form framework 10 at its elevated first position. The castor wheel assemblies 45 can be raised so that the lower frame 16 is supported by the corner legs 17 on the floor or ground surface.

After pouring of the concrete the framework 10 and its associated formwork can be easily stripped away from the concrete surface by the combined use of the hydraulic actuator 30 and the brace 35. It does not require a workman in an elevated position to have to lever the formwork from the concrete surface. When the upper support portion 23 is in its second lower position then the whole assembly can be wheeled easily to the periphery of the building for it to be hoisted to the next level as required. A number of these framework 10 arrangements comprising a lower frame 16 and the upper frame 23 can be assembled together to form the necessary table form between columns which as described above can be quickly positioned prior to concrete being poured and then quickly removed after the concrete has set.

A significant advantage of the framework disclosed herein is that it can be used to both raise the concrete formwork to the required level and then pull the concrete formwork away from the concrete surface and bring it down once the concrete had set. This reduces the labour component and time required to disassemble such formwork using known systems.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that various modifications can be made without departing from the principles of the invention. Therefore, the invention should be understood to include all such modifications in its scope.

The invention claimed is:

1. A framework for use with formwork to support the formwork for concrete casting and for stripping the formwork from a concrete surface, the framework comprising:

a lower ground engaging frame including four tubular legs, an upper frame linearly moveable up and down between a first and a second position with respect to the lower frame, the upper frame including four legs, each one of which is located within a respective tubular leg of the lower frame and moves up and down telescopically with respect to the respective tubular leg of the lower frame, and an actuator provided on the framework that extends and retracts linearly moving the upper frame, where the upper frame supports and holds the formwork in place for concrete casting in the first position and linearly retracts to the second position; and a brace extending from a framework portion other than the upper frame to the concrete surface;

wherein in use, the brace ensures that the movement of the upper frame from its first to its second position results in the stripping of the formwork from the concrete surface.

2. The framework according to claim 1, wherein in use the brace applies a force to the framework portion in a direction that is substantially the same as the direction of movement of the upper frame from the first to the second position.

3. The framework according to claim 1, wherein the legs of the lower frame engage the ground or floor to support the framework.

4. The framework according to claim 1, further comprising a plurality of jacking supports located on the lower frame that each engage the ground or floor to support the framework and which are each individually adjustable to extend or retract so as to adjust the height or angle of the framework.

5. The framework according to claim 1, wherein the brace is releasably secured with respect to the lower frame and can be moved upwardly and fixed in position when the upper frame is in an extended first position.

6. The framework according to claim 5, wherein the formwork has an aperture within which the end of the brace locates so that it is against the concrete surface when it is cast.

7. The framework according to claim 6, wherein the lower frame has a collar secured thereto, and the brace is slidably locating through the collar and securable with respect to the collar.

8. The framework according to claim 2, wherein a brace is provided on opposing sides of the framework.

9. The framework according to claim 2, wherein two braces are provided on opposing sides of the framework.

10. The framework according to claim 1, wherein the actuator comprises a hydraulic actuator positioned between the upper and lower frames to move the upper frame between its first and second positions.

11. The framework according to claim 10, wherein two hydraulic actuators are provided at opposing sides of the framework.

12. The framework according to claim 4, wherein the legs of the upper frame project out of the lower end of the legs of the lower frame and act to lift the lower frame clear off the ground or floor.

13. The framework according to claim 12, further comprising ground engaging wheels that can be raised or lowered and that can support the framework to enable it to be moved, the wheels being moved into or out of ground or floor engaging position when the lower frame is raised.

14. The framework according to claim 1, wherein the brace extends from the lower frame to the concrete surface, and wherein in use, the brace ensures that movement of the upper frame from its first to its second position results in stripping by preventing upward movement of the lower frame.

* * * * *